US005697023A

United States Patent [19]

Yamazaki

[11] Patent Number: 5,697,023

[45] Date of Patent: Dec. 9, 1997

[54] ELECTROPHOTOGRAPHIC DEVICE FOR ENSURING THE COMPATIBILITY OF AN ELECTROPHOTOGRAPHIC PROCESS UNIT TO BE RECEIVED IN AN ELECTROPHOTOGRAPHIC APPARATUS BODY

[75] Inventor: Hiroyuki Yamazaki, Tokyo, Japan

[73] Assignee: Kabushiki Kaisha TEC, Shizuoka, Japan

[21] Appl. No.: 573,453

[22] Filed: Dec. 15, 1995

[30] Foreign Application Priority Data

Dec. 21, 1994 [JP] Japan ..... 6-318703

[51] Int. Cl.[6] ..... G03G 15/00

[52] U.S. Cl. ..... 399/111; 399/13

[58] Field of Search ..... 355/200, 210, 355/206, 208; 347/152, 222; 358/401; 399/13, 110, 111

[56] References Cited

U.S. PATENT DOCUMENTS

| | | | |
|---|---|---|---|
| 4,977,429 | 12/1990 | Tani et al. | 355/206 X |
| 5,107,304 | 4/1992 | Haneda et al. | 355/210 X |
| 5,223,938 | 6/1993 | Mizutani et al. | 355/208 X |
| 5,521,683 | 5/1996 | Miyamoto et al. | 355/208 X |

FOREIGN PATENT DOCUMENTS

| | | |
|---|---|---|
| 2-181759 | 7/1990 | Japan . |
| 4-156469 | 5/1992 | Japan . |

*Primary Examiner*—Arthur T. Grimley

*Assistant Examiner*—Sophia S. Chen

*Attorney, Agent, or Firm*—Frishauf, Holtz, Goodman, Langer & Chick

[57] ABSTRACT

An electrophotographic device for enabling an electrophotographic process unit to be detachably received in an inner receiving section of an electrophotographic apparatus body. The electrophotographic apparatus body is selected from a plurality of kinds of apparatus bodies differing in their performances including an older type apparatus body and a newer type apparatus body, and the electrophotographic process unit is selected from a plurality of kinds of process units including an older type process unit corresponding to the older type apparatus body and a newer type process unit corresponding to the newer type apparatus body. The electrophotographic device includes a fitting structure integrally provided on at least one of the electrophotographic apparatus body and the electrophotographic process unit. The fitting structure enables the electrophotographic process unit to be received in the inner receiving section of the electrophotographic apparatus body in a predetermined state when the electrophotographic apparatus body is the older type apparatus body and the electrophotographic process unit is one of the older type process unit and the newer type process unit, and when the electrophotographic apparatus body is the newer type apparatus body and the electrophotographic process unit is the newer type process unit. However, the fitting structure prevents the electrophotographic process unit from being received in the inner receiving section of the electrophotographic apparatus body in the predetermined state when the electro-photographic apparatus body is the newer type apparatus body and the electrophotographic process unit is the older type process unit.

10 Claims, 13 Drawing Sheets

ELECTROPHOTOGRAPHIC DEVICE FOR ENSURING THE COMPATIBILITY OF AN ELECTROPHOTOGRAPHIC PROCESS UNIT TO BE RECEIVED IN AN ELECTROPHOTOGRAPHIC APPARATUS BODY

BACKGROUND OF THE INVENTION

1. Field of the Invention

The present invention relates to an electrophotographic apparatus for a copying machine, printing apparatus, facsimile apparatus, etc., and in particular, an electrophotographic apparatus including a structure for detachably receiving an electrophotographic process unit in an electrophotographic apparatus body.

2. Description of the Related Art

Generally, an electrophotographic apparatus mounted as a printing section in a facsimile apparatus is, for example, of such a structure that an electrophotographic process unit is detachably received in a unit holding section in an apparatus body. Such a structure allows ready maintenance, etc., of the electrophotographic process unit and is very convenient.

With the above-mentioned structure, if a newly improved version of the apparatus, for example, in the same line of products is added as a new design model, an electrophotographic apparatus body and electrophotographic process unit can be independently developed in accordance with the contents of the new design model. Further, the new model of the electrophotographic process unit can be applied to an existing model of the electronic apparatus body to obtain an improved version of function. In this case, the newly improved version of the electrophotographic process unit is so configured as to be accommodated in not only the new model of the electrophotographic apparatus body but also the existing model of the electrophotographic apparatus body.

In this case, however, there is a risk that the user will inadvertently incorporate the existing model of the electrophotographic process unit into the new model of the electrophotographic apparatus body. If this is the case, then there arises a noncoincidence in performance between the apparatus body and the electrophotographic process unit. This may cause a failure in performance and, in the worst case, the apparatus involved may be damaged.

SUMMARY OF THE INVENTION

It is accordingly the object of the present invention to provide an electrophotographic apparatus which ensures compatibility of its electrophotographic apparatus body with an electrophotographic process unit of a newer model than the electrophotographic apparatus body so that an electrophotographic process unit of an older model than the electrophotographic apparatus body is prevented from being inadvertently mounted there and, by doing so, ensures an improved assembly with high reliability.

The object of the present invention can be achieved by an electrophotographic apparatus comprising:

a fitting structure provided at at least one of the electrophotographic apparatus body and electrophotographic process unit and adapted to, when the electrophotographic process unit corresponding to a newer type of the electrophotographic apparatus body than the electrophotographic apparatus body is received in the inner receiving section of the electrophotographic apparatus body, allow the electrophotographic process unit to be received there in a predetermined state and, when that electrophotographic process unit corresponding to an older type of the electrophotographic apparatus body than the electrophotographic apparatus body is received in the inner receiving section of the electrophotographic apparatus body, allow the electrophotographic process unit to be received there in a predetermined state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS (First Embodiment)

A first embodiment of the present invention will be explained below with reference to the accompanying drawings. Of a plurality of models of facsimile apparatus in the same line of products, an existing popular apparatus and its improved version of an apparatus will be explained below by way of example.

Figure 1:
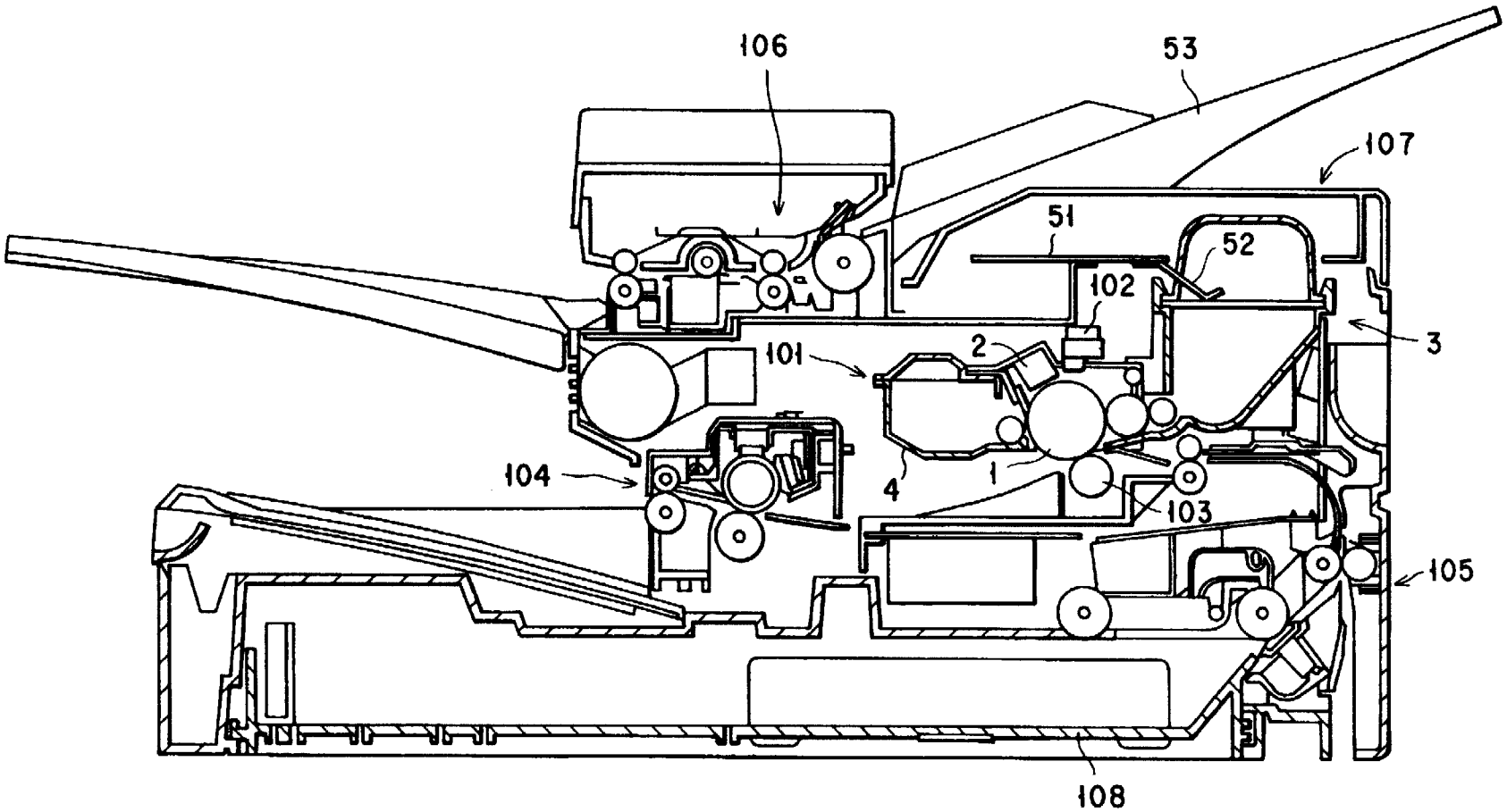
FIG. 1 is a view, partly taken away, showing a general arrangement of a facsimile apparatus incorporating therein an electrophotographic apparatus according to a first embodiment of the present invention.

FIG. 1 is a view, partly taken away, showing the whole structure of the facsimile apparatus equipped with an electrophotographic apparatus according to a first embodiment of the present invention.

The facsimile apparatus comprises a process unit 101, exposure unit 102, transfer unit 103, fixing unit 104, sheet supply mechanism 105, transmitting mechanism 106, upper open/close cover 107 with the transmitting mechanism 106 attached thereto, and sheet tray 108.

The process unit 101 provides an integral structure of a photosensitive drum 1, charger 2, developing unit 3 and cleaning unit 4 and is of such a type that, with the use of the exposure unit 102, a toner image is formed on the photosensitive drum 1 by a so-called carlson process. The process unit 101 is detachably received in a unit holding section in the apparatus body.

The exposure unit 102 has, for example, an LED head and exposes the photosensitive drum 1 with light to create an electrostatic latent image on the drum surface. The transfer unit 103 transfers a toner image which is created on the drum surface to a recording sheet (not shown) supplied from the sheet tray 108 by means of the sheet supply mechanism 105. The fixing unit 104 fixes the toner image which is transferred to the recording sheet onto the recording sheet.

The transmitting mechanism 106 has, for example, a CCD line sensor and optically reads out a transmitting document image and, upon the photoelectric conversion of it, supplies a corresponding image signal to a transmitting system circuit not shown. The upper open/close cover 107 is so pivotally mounted relative to the apparatus body and, at its upper side, equipped with a transmitting document rest section 53 for supplying the transmitting document to the transmitting mechanism 106. Further, a leaf spring 52 is attached to an inner chassis 51 of the upper open/close cover 107. With the open/close cover 107 closed, the leaf spring 52 presses down the process unit 101 and fixes it in place.

Figure 2:
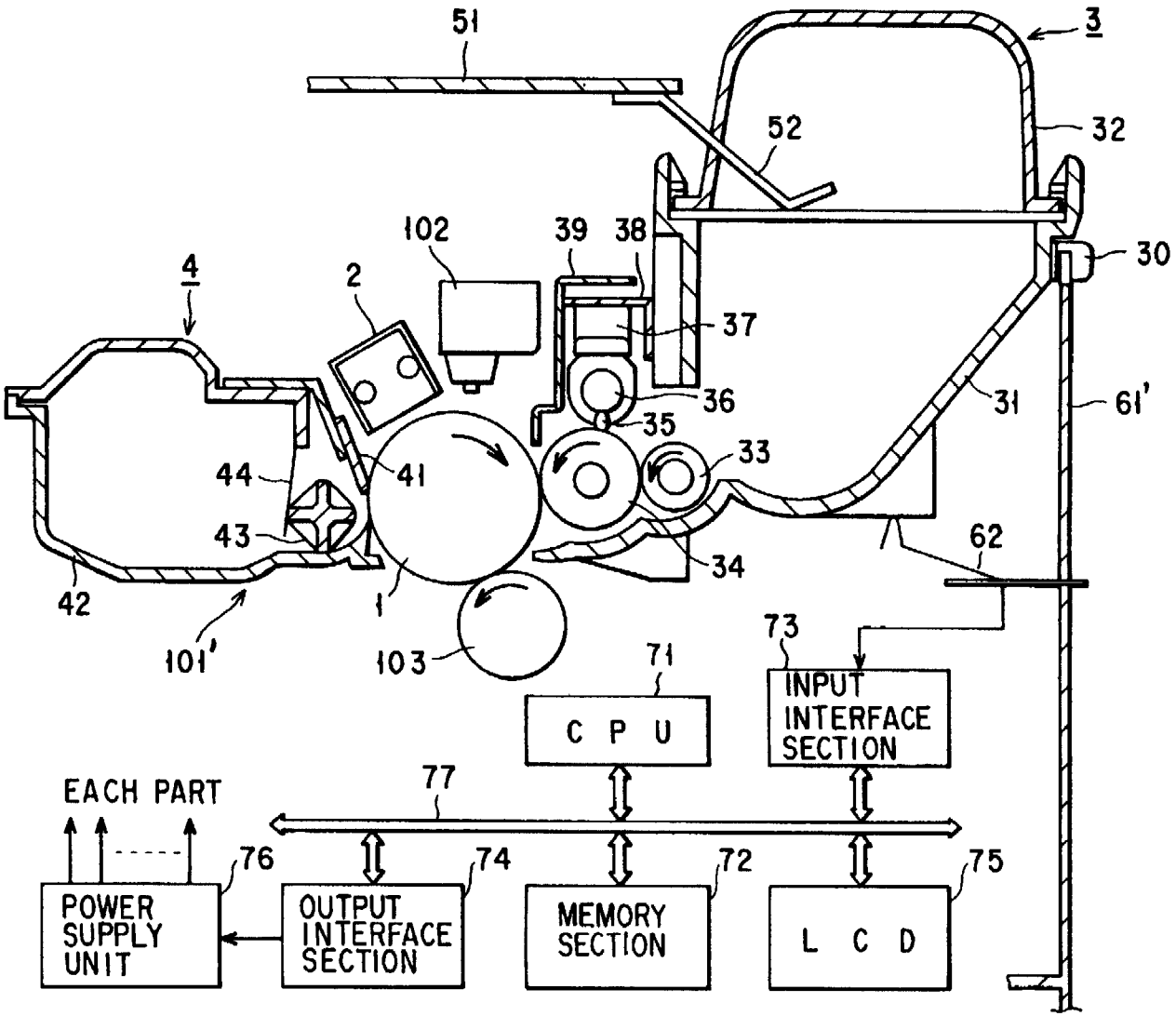
FIG. 2 is a view, partly taken away, showing a practical arrangement of a process unit of an existing popular apparatus and its peripheral area.

The above-mentioned process unit 101 is so configured as set out below. FIG. 2 is a view, partly taken away, showing a practical arrangement of a current popular machine's process unit 101' and its peripheral area together with a function block corresponding to a major arrangement of an electric circuit in the apparatus body.

The photosensitive drum 1 has its surface coated with a photosensitive conductive material to provide a photosensitive layer and is rotated by a drive transmitting mechanism, not shown, in a direction as indicated by an arrow in FIG. 2. Around and along the photosensitive drum 1 are arranged a charger 2, exposure unit 102, developing unit 3, transfer unit 103 and cleaning unit 4. Of these, the photosensitive drum 1, charger 2, developing unit 3 and cleaning unit 4 are integrally supported by a side cover, not shown, to provide a process unit 101'. The charger 2 is comprised of, for example, a well known scorotron charger to allow the outer surface of the photosensitive drum 1 to be uniformly charged to a given potential (for example, −600 V).

The developing unit 3 comprises a toner hopper 31, toner pack 32, supply roller 33, developing roller 34, developing blade 35, support rod 36, leaf spring 37, support 38 and reinforcing plate 39.

The toner hopper 31 is comprised of a hollow container opened at the upper side and partly at the side area and holds the toner, not shown, therein. At the upper open area, a toner pack 32 is provided. The toner pack 32 is comprised of a container opened at one side, containing the toner and sealed by a seal. The toner can be supplied into the toner hopper 31 by removing the seal with the toner hopper 31, not shown, mounted thereon.

The supply roller 33 is located at the opened area at the side of the toner hopper 31 with a portion of the supply roller 33 placed inside the toner hopper 31. The supply roller 33 is placed in contact with the developing roller 34 and rotated with the toner stored in the toner hopper 31 being carried thereon. The carried toner is supplied to the developing roller 34. The developing roller 34 is placed in contact with the outer surface of the photosensitive drum and carries, thereon, the toner supplied from the toner hopper 31. The toner on the developing roller 34 is placed on the rotating surface of the photosensitive drum 1.

A developing blade 35 maintains, at a given level, an amount of toner (toner layer thickness) coming from the developing roller 34 and the toner is tribo-electrically charged. The developing blade 35 is provided on a cylindrical support rod 36 and placed in contact with the developing roller 34. The support rod 36 is pressed against the developing roller 34 side by the leaf spring 37 fixed to the support 38, so that the developing blade 35 is pushed against the developing roller 34. The support 38 is fixed to the side wall of the toner hopper 31. The reinforcing plate 39 is fixed to the support 38 and side cover, not shown, of the process unit 101' to enhance the rigidity of the process unit 101' and to prevent flying about of the toner carried on the developing roller 34.

The cleaning unit 4 comprises a cleaning blade 41, spent toner receiving section 42, spent toner roller 43 and check valve 44. Of these, the cleaning blade 41 is placed in contact with the outer surface of the photosensitive drum 1 and scrapes off the toner on the outer surface of the photosensitive drum 1. The spent toner roller 43 feeds the spent toner which is scraped off by the cleaning blade 41 into the inner space of the spent toner receiving section 42. The spent toner receiving section 42 recovers the spent toner fed by the spent toner roller 43. The check valve 44 prevents the spent toner which is recovered into the inner space in the spent toner receiving section 42 from flowing back toward the photosensitive drum 1 side.

Figure 3:
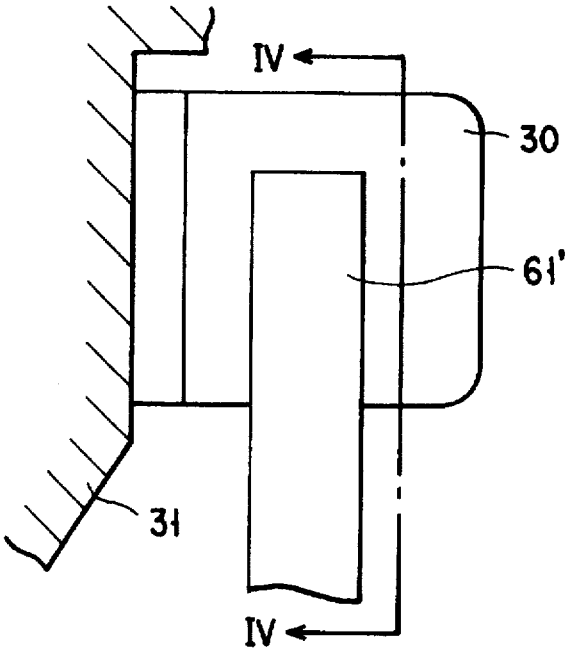
FIG. 3 is a view showing the existing apparatus of FIG. 2 with its featuring enlarged.
Figure 4:
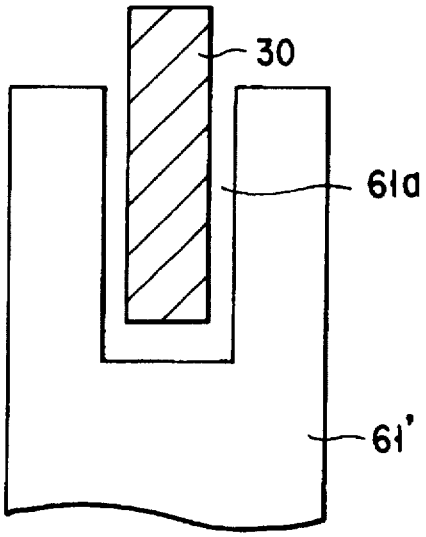
FIG. 4 is a cross-sectional view as taken along IV—IV in FIG. 3.

In the process unit 101' of the old type thus arranged, a projection 30 is integrally provided on the outer wall area of the developing unit 3 side. Further, a cutout 61*a* is formed in a position corresponding to the projection 30 at the upper end portion of the side wall area of the chassis 61' of the apparatus body. FIGS. 3 and 4 show the projection 30 and cutout 61*a* in enlarged form, FIG. 3 being a side view and FIG. 4 a cross-sectional view as taken along line IV—IV in FIG. 3. As evident from these Figures, the cutout 61*a* is set greater in width than the width of the projection 30. The depth of the cutout 61*a* is so set that the projection 30 is abutted against it when the old type's process unit 101' is received in a normal state. By dosing so, the projection 30 of the process unit 101' is not abutted against the upper end of the side wall of the chassis 61' of the apparatus body when the process unit 101' is received in the unit receiving section of the apparatus body.

A unit detection switch 62 is provided on the bottom of the unit receiving section of the apparatus body. The unit detection switch 62 detects whether or not the process unit 101' is received in a normal state in the unit receiving section and make such decision. That is, the unit detection switch 62 is comprised of, for example, a microswitch. With the process unit 101' received in a normal state in the unit receiving section, the switch contact is closed to deliver a unit detection signal and, with the process unit 101' not received in the normal state in the unit receiving section, the switch contact is opened to deliver a unit non-detection signal.

The electric circuit arrangement as shown in FIG. 2 comprises a central processing unit (CPU) 71, memory section 72, input interface section 73, output interface section 74, liquid crystal display (LCD) 75 and power supply unit 76. The CPU 71, memory section 72, input interface section 73, output interface section 74 and LCD 75 are connected together via a system bus 77 comprising a data bus, address bus and control bus. The power supply unit 76 is connected to the output interface section 74.

CPU 71 operates based on an operation program stored in the memory section 72 and controls the operation of the present facsimile apparatus. Based on the detection signal delivered from the unit detection switch 62, the CPU 71 decides whether or not the process unit 101' is received in the normal state. When the process unit 101' is not received in the normal state, the CPU 71 inhibits the power supply of the process unit 101' by the power supply unit 76 and has the function of setting the apparatus in an inoperative state. Further, the CPU 71 has also the function of displaying a message informing the LCD 75 that the process unit is not correctly set or a mark in place of the message.

The memory section 72 has a read only memory (ROM) and random access memory (RAM), stores an operation program of the PCU 71 and temporarily stores various data items necessary for various processings by the CPU 71.

The input interface section 73 receives various kinds of signals (output signal, etc., of the sensor) which are obtained to perform the various processings. The above-mentioned unit detection switch 62 is connected to the input interface section 73 and the output signal of the unit detection switch 62 is imparted to the input interface section 73. The input interface section 73 receives an output signal and other given signals of the unit detection switch 62 and outputs the signal to the system bus 77 on the basis of an instruction from the CPU 71. The output interface section 74 outputs an instruction signal to each part of the current facsimile apparatus, that is, an instruction signal corresponding to instruction data which is output to allow the operation of each section of the current facsimile apparatus to be controlled by the CPU 71.

The LCD 75 displays, under control of the CPU 71, various kinds of information to be informed to the user, etc., of the current facsimile apparatus.

The power supply unit 76 is adapted to supply electric power to each part of the current facsimile apparatus. The power supply unit 76 has the function of stopping the power supply to a given area when the inhibition of the power supply is instructed by the CPU 71.

Figure 5:
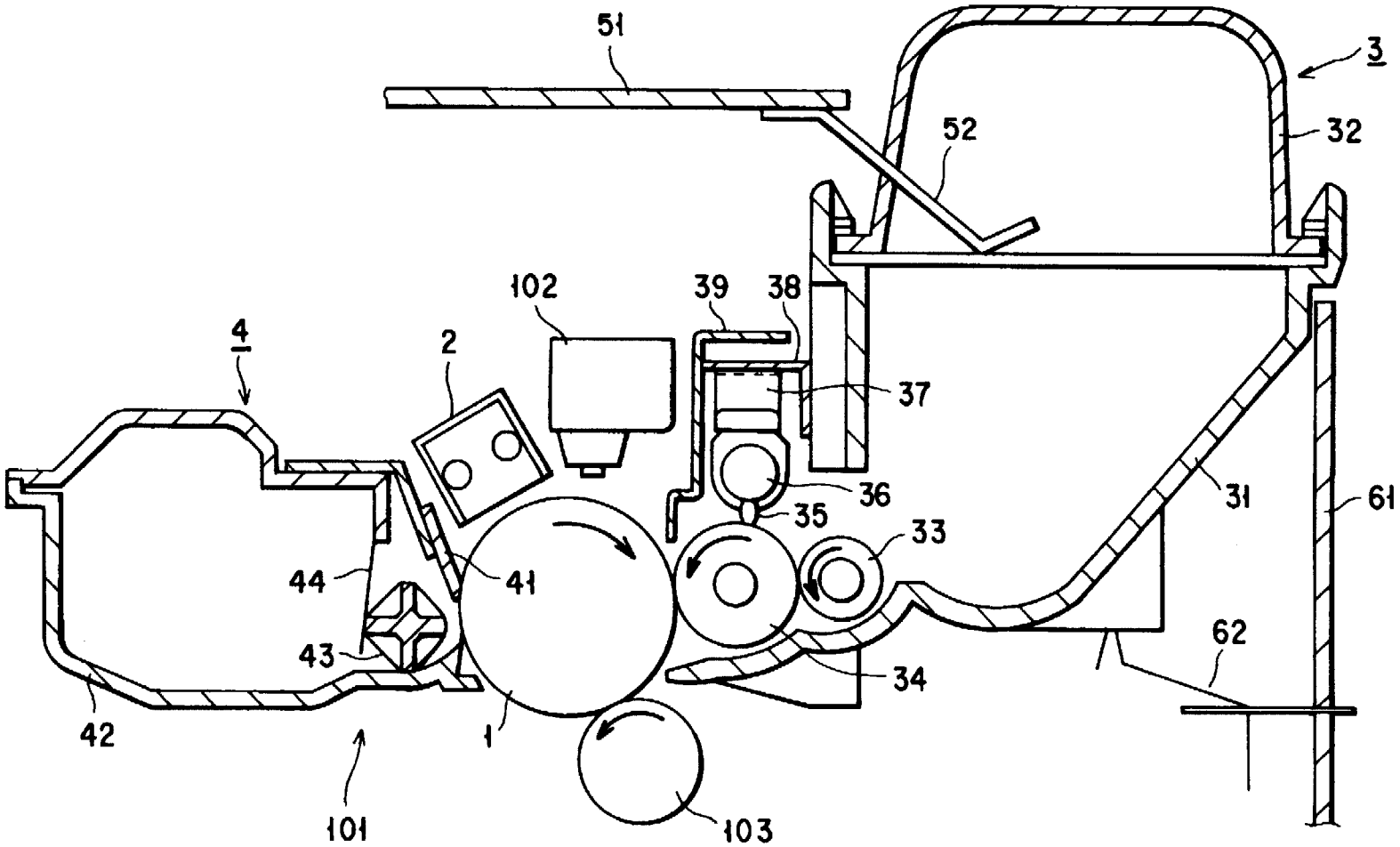
FIG. 5 is a view, partly taken away, showing a practical arrangement of a process unit of a new model and its peripheral area.

FIG. 5 is a view, partly taken away, showing a practical arrangement of a new kind of the process unit 101 and its peripheral area. In FIG. 5 the same reference numerals are employed to designate parts or elements corresponding to those shown in FIG. 2 and any further explanation is, therefore, omitted. Further, the arrangement of the electrical circuit portion is of the same as the old model machine and its illustration and its detailed explanation are omitted for brevity.

Figure 6:
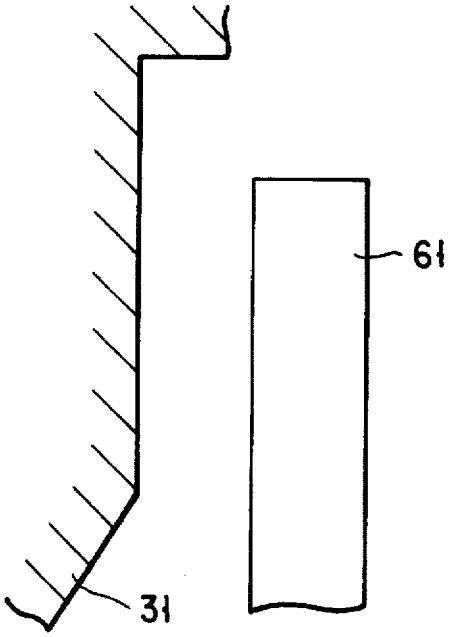
FIG. 6 is a view showing the new model of FIG. 5 with its featuring area enlarged.
Figure 7:
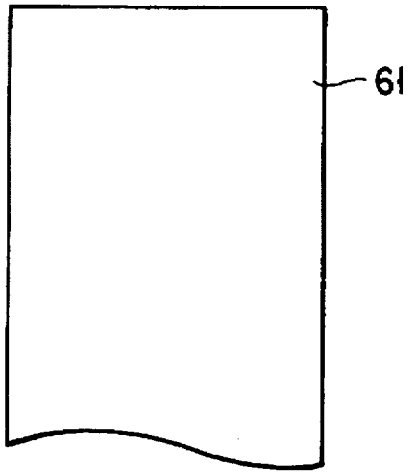
FIG. 7 is a side view showing a state of the featuring area of FIG. 6.

As illustrated in FIG. 5, at the outer wall of the developing unit 3 side in the new type of the process unit 101 no projection 30 is provided unlike in the old type as set out above and no cutout 61*a* is provided at the upper end portion of a chassis 61 of an apparatus body. FIGS. 6 and 7 are enlarged view showing an outer wall of the above-mentioned developing unit 3 side and an upper end portion of the side wall of the chassis 61, FIG. 6 being a side view and FIG. 7 being a view as seen in a right-handed direction of FIG. 6.

In the case where the new type of the process unit 101 compatible in performance with the new type of an apparatus body is incorporated into the new type of the apparatus body it will be seen from the above-mentioned arrangement that, since no projection 30 is provided on the outer wall section of the developing unit 3 side of the process unit 101 as set out above, the new type of the processing unit 101 is received in a normal state in a unit receiving section of the apparatus body as shown in FIG. 5. For this reason, a unit detection switch 62 is placed in a closed state with its switch contact pressed by the bottom of the process unit 101, so that a unit detection signal is output from the unit detection switch 62.

Then in the case where the new type of the process unit 101 is incorporated into the apparatus body of an old type it will be seen that, since no projection 30 is provided on the outer wall of the developing unit 3 side of the process unit 101 as set out above, the new type of the process unit 101 is received in the normal state in the unit receiving section as when the new type of the apparatus body is incorporated. Even in this case, the unit detection switch 62 has its contact closed by being pushed by the bottom of the process unit 101, so that a unit detection signal is output from the unit detection switch 62.

If, on the other hand, the process unit 101' of the old type compatible in performance with the apparatus body of the old type is incorporated, since the cutout 61*a* is provided at the upper end portion of the side wall of the chassis 61', the projection 30 on the process unit 101' is loosely fitted in the cutout 61*a* so that it is not abutted against the upper end of the side wall of the chassis 61'. That is, the cutout 61*a* acts as an escape area of the projection 30. Therefore, the process unit 101' of the old type is received in the normal state in the unit storage area of the apparatus body of the old type as shown in FIG. 2. Even in this case, the unit detection switch 62 has its contact pushed by the bottom of the process unit 101' to place it in a closed state. As a result, a unit detection switch 62 delivers a unit detection signal.

Figure 8:
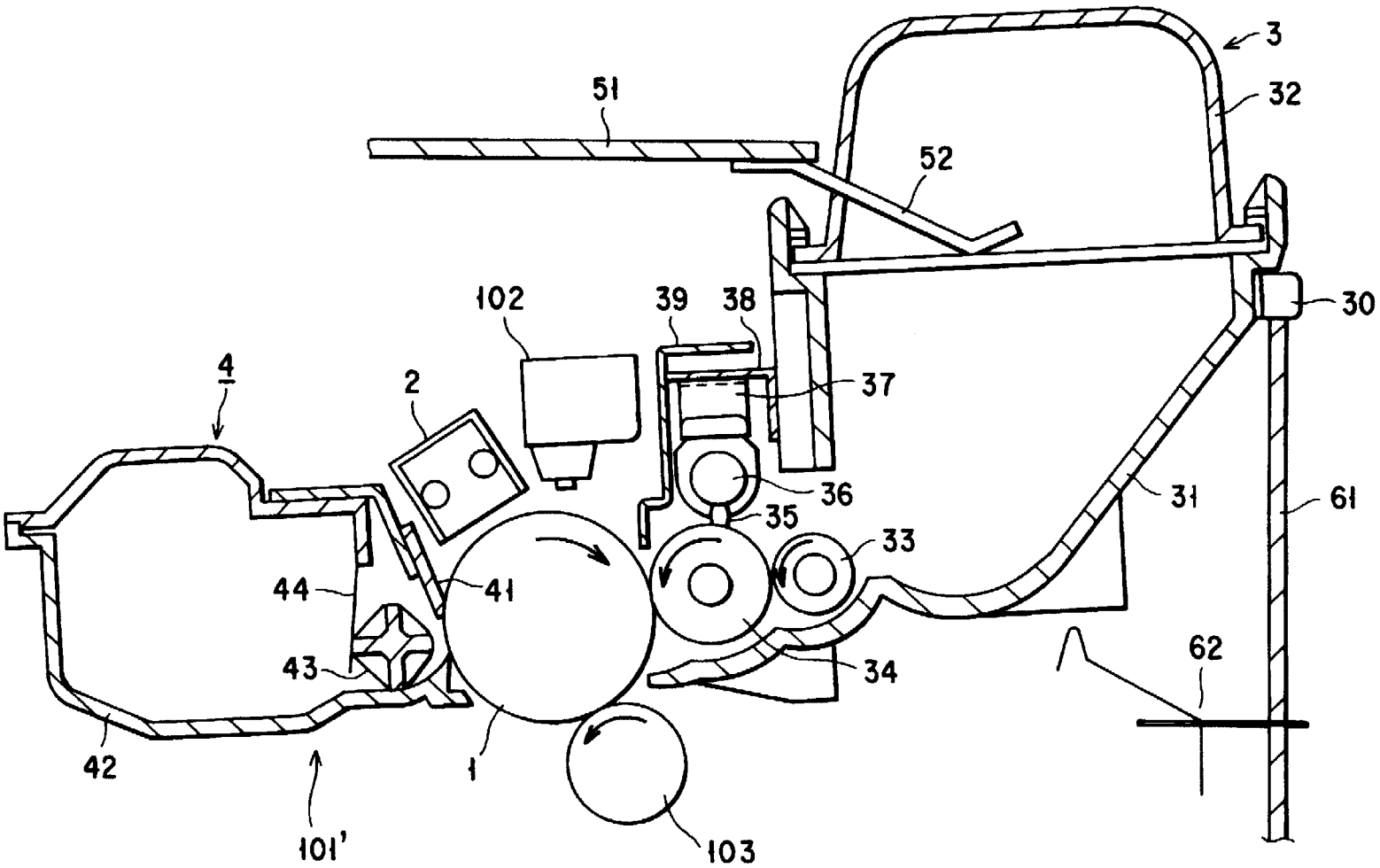
FIG. 8 is a view showing a state in which a process unit of an existing popular apparatus is mounted on an apparatus of a new model.
Figure 9:
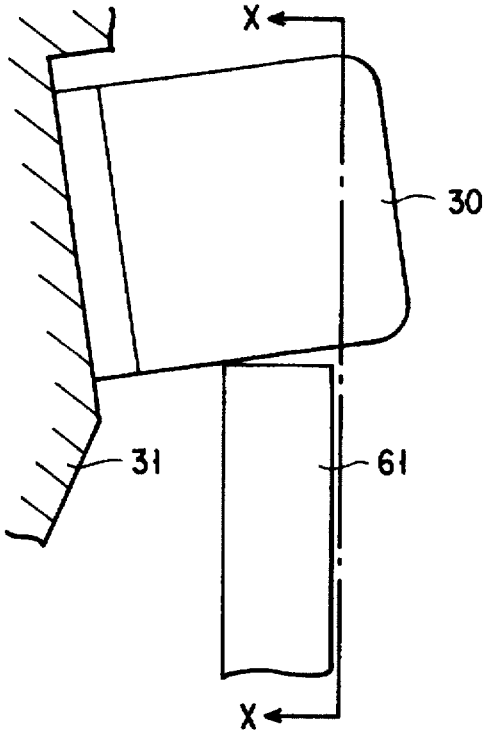
FIG. 9 is a view showing a featuring area of FIG. 8 enlarged.
Figure 10:
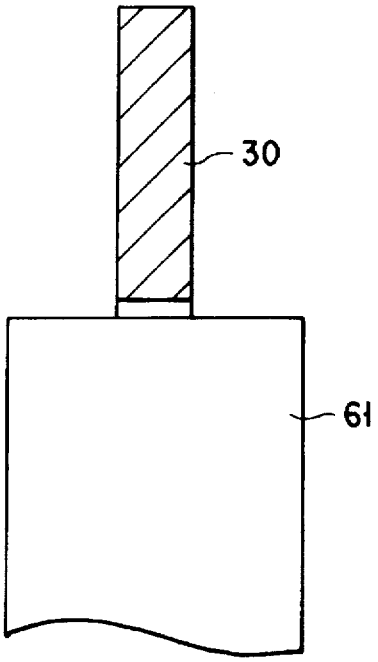
FIG. 10 is a cross-sectional view as taken along line X—X in FIG. 9.

On the other hand, if the process unit 101' of the old type is received in the unit storage section of the new type of the apparatus body, the projection 30 on the process unit 101' abuts against the upper end of the side wall of the chassis 61 as shown in FIGS. 8, 9 and 10 because no cutout is provided on the upper end portion of the side wall of the chassis 61 of the existing model. As a result, the process unit 101' of the old type has its one side placed in a floating state in the unit storage section of the apparatus body of the new model so that it is not received in a normal state. FIG. 8 shows a storage state of the process unit 101' at that time. For this reason, the contact of the unit detection switch 62 is not contacted with bottom of the process unit 101' and placed in an open state, so that a unit non-detection signal is output from the unit detection switch 62.

Figure 11:
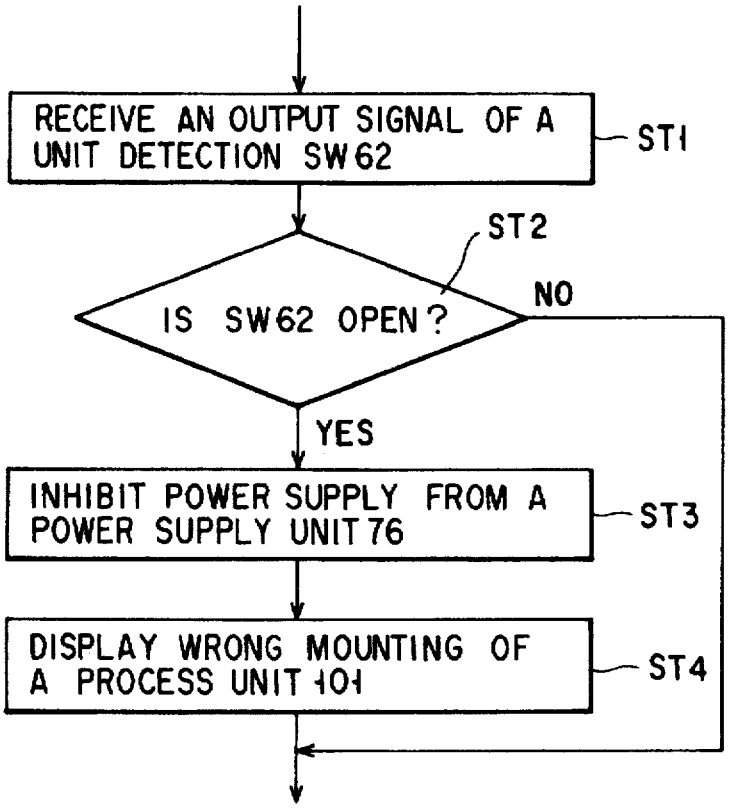
FIG. 11 is a flow chart showing a major process steps of a CPU in FIG. 2.

During the control processing of each part, the CPU 71 receives the output signal of the unit detection switch 62 for each given timing (for example, each given period) (step ST1 in FIG. 11). The CPU 71 decides whether or not the unit detection switch 62 is placed in the open state (step ST2) on the basis of whether or not the received signal is a unit non-detection signal.

Here, there are the case where the process unit 101 of the new model is incorporated into the apparatus body of the new model, the case where the process unit 101' of the existing model is incorporated into the apparatus body of the old type and the case where the process unit 101 of the new model is mounted in the apparatus body of the old type. If the unit detection switch 62 is placed in the closed state, the CPU 71 decides that a received state of the process unit is in the normal state and continues the operation processing of each part.

In the case where the process unit 101' of the old type is mounted in the apparatus body of the new model and the unit detection switch 62 is in the open state, the CPU 71 decides that the process unit is not normally received and, at that time, imparts an electric power supply inhibiting instruction to the power supply unit 76 via the output interface section 74 (step ST3), thus allowing the stopping of the electric power supply to the process unit 101'. Even if, for example, the power supply line is connected thereto, no power supply is made to the process unit 101', so that the apparatus is placed in a non-operative state.

Even if the process unit 101' of the old type not meeting the performance of the apparatus body of the new model is wrongly mounted, the apparatus is not operated, there being no fear that the apparatus is used in a less-performance state or the apparatus causes trouble or breakage. That is, it provides added reliability to the apparatus.

After supplying an instruction for inhibiting the supply of the electric power to the power supply unit 76, the CPU 71 enables the LCD 75 to display a massage for informing the user that the process unit is not correctly set or a mark, etc., in place of the massage. By looking at the message or mark on the LCD the user can readily but positively recognize the state in which the process unit is wrongly mounted.

With the apparatus of the present embodiment, the projection 30 is provided on the process unit 101' of the old type and the cutout 61*a* is provided in the chassis 61' of the apparatus body to escape the projection 30. On the other hand, neither the projection 30 nor the cutout 61*a* are provided at the process unit 101 of the new model and chassis of the apparatus body. By doing so, when the process unit 101' of the old type is to be received in the apparatus body of the new model, no normal receiving state is created there. This state is determined, as there being no proper unit, by the unit detection switch 62 and the CPU 71 and the apparatus involved is set in the inoperative state in accordance with a result of determination.

According to the present embodiment, even in the case where any assembling operator or maintenance personal inadvertently mounts the process unit 101' of the existing popular unit 101' in the new model of the apparatus body, the process unit 101' abuts against the chassis 61 of the apparatus body 61 and is not received in the normal state and the apparatus involved is set in an inoperative state. For this reason, the apparatus will not be operated in a wrongly mounted state, thus avoiding a fear that it is used in a state not satisfying a given performance or that the apparatus causes trouble or breakage. That is, it is possible to enhance the reliability of the apparatus.

Further, the process unit 101 of the new model is received in the normal state in either the apparatus of the new model or the apparatus of the old type. For this reason, it is possible to ensure the compatibility of the process unit 101 of the new model with the apparatus body of the old type.

According to the present invention, it is only necessary to provide the projection 30 and cutout 61*a* so as to determine whether or not the process units 101, 101' are received in the normal state. As to the detecting mechanism and the deciding circuit, the unit detection switch 62 provided at any model is utilized as it is so as to detect the presence or absence of the process unit. In order to determine whether or not the process unit is received in the normal state, it is only necessary to modify some associated structure so that there is no need to provide any new detecting mechanism and deciding circuit This structure can be readily achieved.

In the present embodiment, an adequate displacement amount is set to the leaf spring 52 so as to press the process units 101, 101' received in the apparatus body. Even in the case where the process unit 101' of the old type is not received in the normal state in the unit receiving section of the apparatus body of the new model and is set in a floating state with the upper open/close cover 107 closed, there is no fear that the upper open/close cover 107 collides with the process unit 101 and hence both are damaged.

Further, according to the present invention, it is detected that the process unit 101' is received in the normal state in the apparatus body, a message to that effect or mark in place of the massage is displayed on the LCD 75. By looking at the message or mark on the LCD 75, the user can recognize any wrongly mounted state readily and positively.

Further, in the present embodiment, the projection 30 is integrally provided on the process unit 101' side and the cutout 61*a* is provided on the apparatus body side, so that no extra means is required for distinguishing between the types of associated process units. That is, in the technique disclosed in Jpn. Pat. Appln. KOKAI Publication No. 4-156469, for example, separate fitting members of mutually different shapes are mounted on two kinds of units of the same shape or separate fitting members of the same shape are mounted at different places on two kinds of units of the same shape. By doing so it is possible to distinguish between these units. According to this technique, it is necessary to correctly mount the fitting member at the unit. This is cumbersome and, if the fitting member is not correctly mounted there, it is not possible to correctly mount the unit in the associated apparatus body. According to the present invention, there arises no such inconvenience thus encountered.

According to the above-mentioned technique, in an apparatus body a process unit of a newer model than the apparatus body is inhibited from being mounted, so that the compatibility between both cannot be achieved. This aspect is also different from the present embodiment.

(Second Embodiment)

In the first embodiment, the projection 30 and cutout 61*a* are provided at the process unit 101' of the old type and chassis 61' of the apparatus body and neither the projection 30 nor the cutout 61*a* are provided at the process unit 101 and chassis 61 of the apparatus body of the new model. A projection may be provided at any of the process unit 101' of the old type and the process unit 101 of the new model and a cutout may be provided at any of the chassis 61' of the apparatus body of the old type and chassis 61 of the apparatus body of the new model.

A second embodiment of the present invention having such an arrangement as set out above will be explained below.

Figure 12:
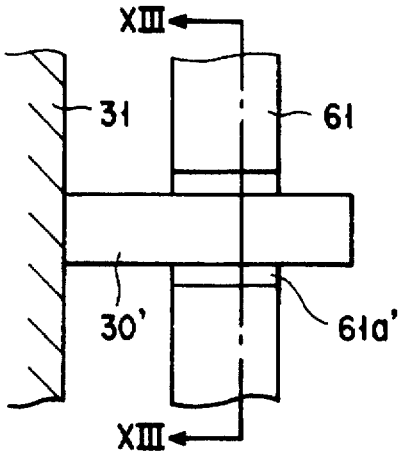
FIG. 12 is a view showing a featuring area of a facsimile apparatus (existing popular apparatus) incorporating therein an electrophotographic apparatus according to a second embodiment of the present invention.
Figure 13:
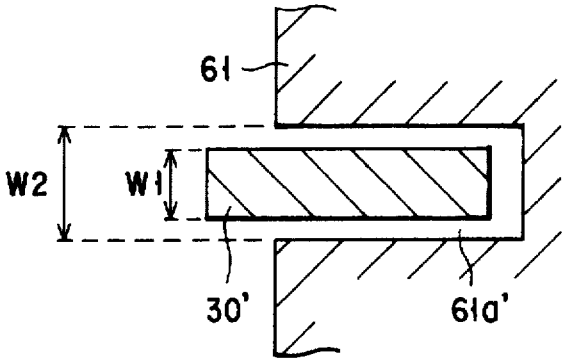
FIG. 13 is a cross-sectional view, taken along line XIII—XIII in FIG. 12.

FIGS. 12 and 13 are expanded view showing a structure at an outer wall of a developing unit side of a process unit 101 and upper end portion of a side wall of a chassis 61, FIG. 12 being a top view and FIG. 13 a cross-sectional view as taken along line XIII—XIII in FIG. 12. The rest of FIGS. 12 and 13 is the same as that shown in FIGS. 12 and 13 and, here, its illustration and detail explanation are, therefore, omitted for brevity.

In the process unit 101 of the new model in the present invention as shown in FIGS. 12 and 13, a projection 30' is integrally provided on the outer wall of the developing unit 3. A cutout 61*a'* is provided on the upper end portion of the side wall of the chassis 61*a'* of the apparatus body of the new model. The width W2 of the cutout 61*a* is set larger than a width W1 of the projection 30'. Further, the depth of the cutout 61*a'* is so set that it does not abut against the projection 30' when the process unit 101 of the new model is received in a normal state. By doing so, when the process unit 101 is received in a unit receiving section of the apparatus body the projection 30' of the process unit 101 does not collide with the upper end of the side wall of the chassis 61 of the apparatus body.

Figure 14:
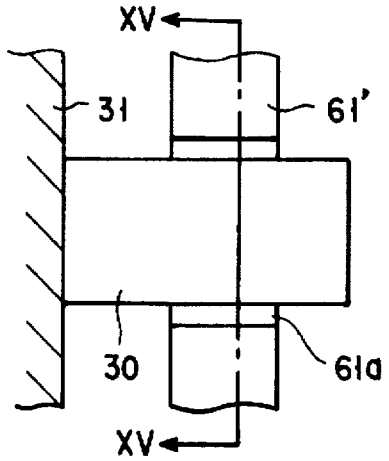
FIG. 14 is a view showing a featuring area of a facsimile apparatus (new model) incorporating therein the electrophotographic apparatus according to the second embodiment.
Figure 15:
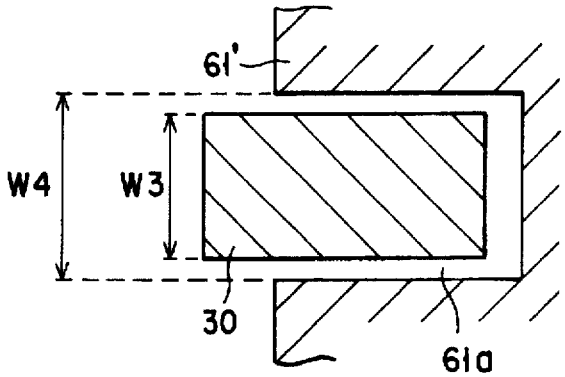
FIG. 15 is a cross-sectional view as taken along line XV—XV in FIG. 14.

That is, the projection 30' and cutout 61*a'* have the same relation as the projection 30 and cutout 61*a* at the process unit 101' of the old type. In this connection it is to be noted that the width W1 of the projection 30' and width W2 of the cutout 61*a'* are so set as to be smaller than a width W3 of the projection 30 on the process unit 101' of the old type and width 4 of the cutout 61*a*. FIGS. 14 and 15 are enlarged views showing the outer wall portion of the developing unit 3 side of the process unit 101' of the old type and upper end portion of the side wall of the chassis 61', FIG. 14 being a top view and FIG. 15 being a cross-sectional view as taken along line XV—XV in FIG. 14.

As evident from the arrangement above, if the process unit 101 compatible in performance with the apparatus body of the new model is incorporated in that apparatus body, since a cutout 61*a'* is provided at the upper end of the side wall of a chassis 61, a projection 30' on the process unit 101 is loosely fitted in the cutout 61*a'* and does not abut against the upper end portion of the side wall of the chassis 61. That is, the cutout 61*a'* provides an escape area of the projection 30'. As a result, the process unit 101 of the new model is received in a normal state in the unit receiving section of the apparatus body. Therefore, the unit detection switch 62 has its contact pressed by the bottom of the process unit 101 and is put in a closed state, so that a unit detection signal is output from the unit detection switch 62.

In the case where the process unit 101 of the new model is incorporated into the apparatus of the old type, since the cutout 61*a* of the width W4 is provided at the upper end of the side wall of the chassis 61', the projection 30' of the width W1 (which is smaller than the width W4 of the cutout 61*a*) is loosely fitted into the cutout 61*a* and does not abut against the upper end of the side wall of the chassis 61'. That is, the cutout 61*a* serves as an escape area of the projection 30'. For this reason, the process unit 101 of the new model is received in the normal state in the unit receiving section of the old type. Even in this case, the unit detection switch 62 has its contact pushed by the bottom of the process unit 101 and is placed in the closed state and a unit detection signal is output from the unit detection switch 62.

If, on the other hand, the process unit 101' of the old type compatible in performance with the apparatus body of the old type is incorporated therein, since the cutout 61*a* is provided at the upper end portion of the side wall of the chassis 61', the projection 30 on the process unit 101' is loosely fitted in the cutout 61*a* and does not abut against the upper end of the side wall of the chassis 61'. That is, the cutout 61*a* serves as an escape area of the cutout projection 30. For this reason, the process unit 101' of the old type is received in the normal state in the unit receiving section of the apparatus body of the old type. Even in this case, therefore, the unit detection switch 62 has its contact pushed by the bottom of the process unit 101' and is placed in a closed state so that a unit detection signal is output from the unit detection switch 62.

Figure 16:
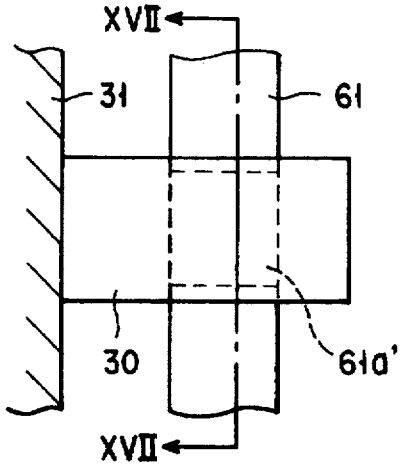
FIG. 16 is a view showing a featuring area of the second embodiment of the present invention when a process unit of an old type is mounted in the apparatus body of the new model.
Figure 17:
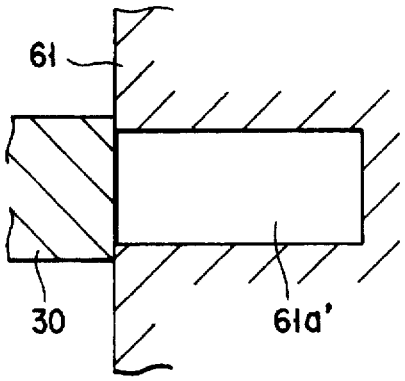
FIG. 17 is a cross-sectional view as taken along line XVII—XVII in FIG. 16.

When the process unit 101' of the old type is to be received in the unit receiving section of the apparatus body of the new model, the cutout 61*a'* of the width W2 (which is smaller than the width W3 of the projection 30 on the process unit 101') formed in the upper end portion of the side wall of the apparatus body the chassis 61 of new model will not admit the projection 30 on the process unit 101' so that the projection 30 abuts against the upper end of the side wall of the chassis 61. As a result, the process unit 101' of the old type is floated at one side in the unit receiving section of the apparatus body of the new model and is not received there in the normal state. For this reason, the contact of the unit detection switch 62 is not contacted with the bottom of the above-mentioned process unit 101' and is placed in the open state, so that the unit non-detection signal is delivered from the unit detection switch 62. FIGS. 16 and 17 show enlarged views of a structure of the outer wall of the developing unit 3 side and upper end portion of a chassis 61 when a process unit 101' of an old type is received in an apparatus body of a new model, FIG. 16 being a top view and FIG. 17 being a cross-sectional view as taken along lien XVII—XVII in FIG. 16.

As evident also from such an arrangement, the present invention can achieve the same advantage as that in the first embodiment by monitoring an output signal of the unit detection switch 62 by an electric circuit similar to that shown in the first embodiment in those process steps similar to those shown in the first embodiment.

According to the present embodiment, even if more than two models are present, provision can be made for this situation by properly varying the widths of the projection 30 and cutout 61*a*. If this is the case, it is necessary to set the width of the projection 30 to be smaller than that of any of those cutouts 61*a* of the existing models.

(Third Embodiment)

Figure 18:
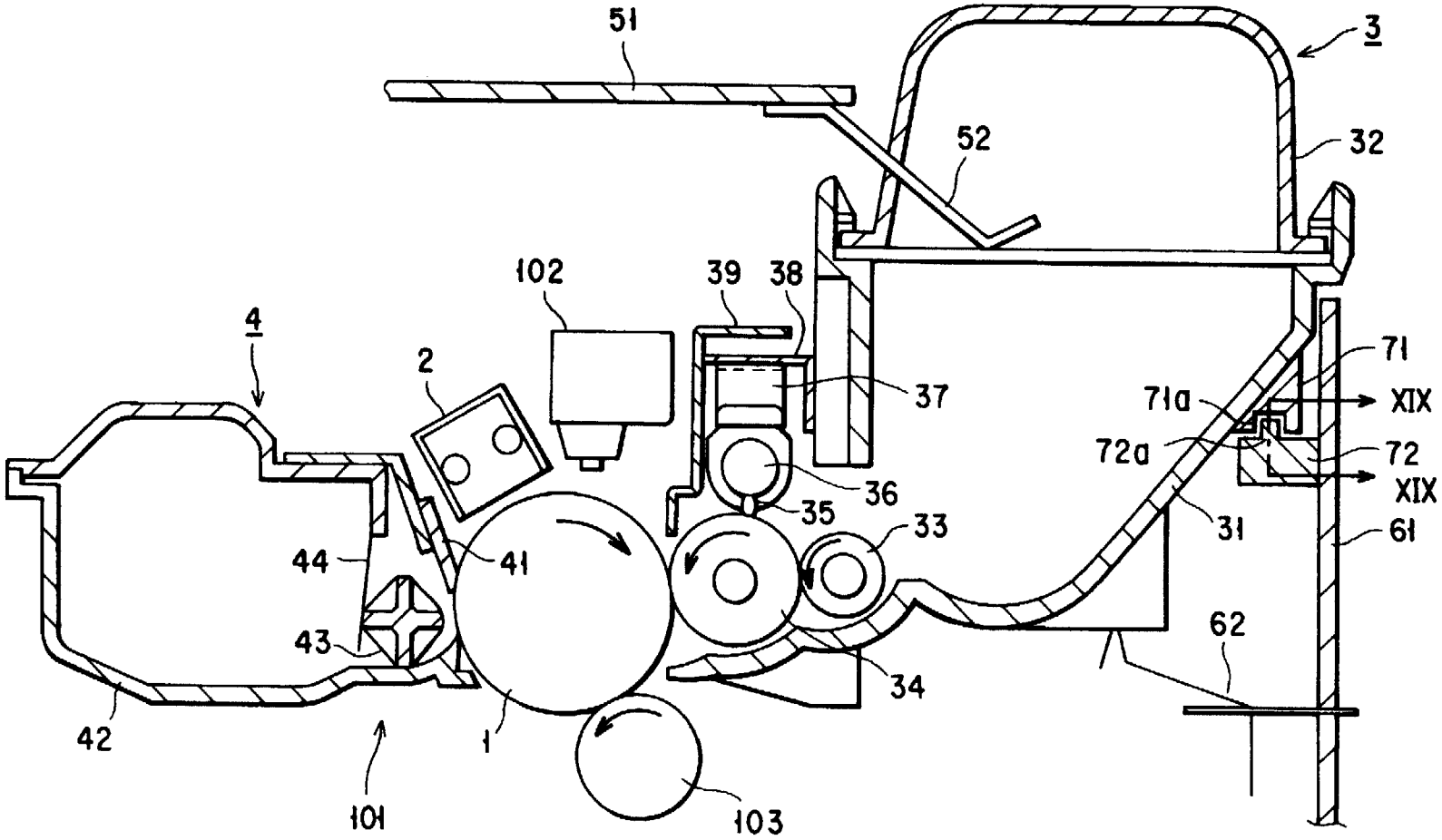
FIG. 18 is a view, partly taken away, showing a practical arrangement of a process unit of a facsimile apparatus incorporating therein an electrophotographic apparatus according to a third embodiment of the present invention and its peripheral area.

FIG. 18 is a view, partly taken away, showing a practical arrangement of a process unit 101 in a facsimile apparatus incorporating therein an electrophotographic apparatus according to a third embodiment of the present invention and its surrounding area. It is to be noted that a whole arrangement of the facsimile apparatus of the present embodiment and its electric circuit are the same as those set out above in the first embodiment. For this reason, their illustration and detail explanation are omitted for brevity sake.

A recess forming section 71 is integrally provided at a process unit 101 having the same structure as that of the facsimile apparatus of the new model set out in connection with the first embodiment and a projection forming section 72 is integrally provided on the side wall of a chassis 61 of an apparatus body. The recess forming section 71 and projection forming section 72 are so arranged that, with the process unit 101 received in the apparatus body, the lower face of the recess forming section 71 faces the upper face of the projection forming section 72. A recess 71a is provided in the lower surface portion of the recess forming section 71 and a projection 72*a* is integrally provided at a position opposite to the recess 71*a*.

Figure 19A:
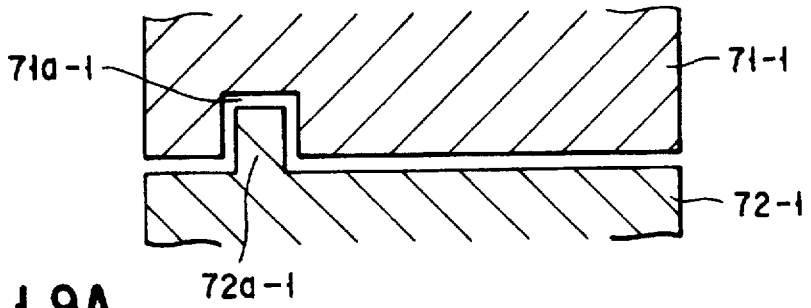
FIG. 19A is a view, taken along line XIX—XIX in FIG. 18, showing a state of an apparatus body and process unit both of an old model.
Figure 19B:
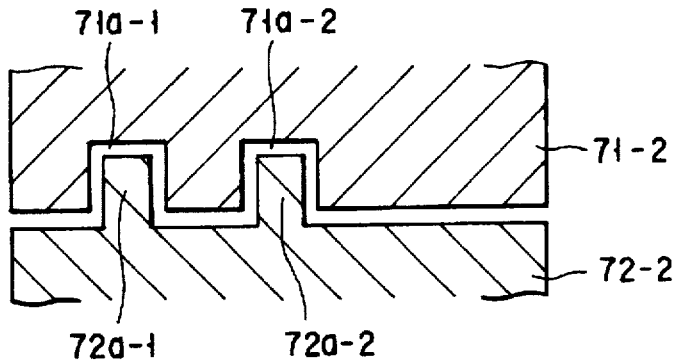
FIG. 19B is a view, taken along line XIX—XIX in FIG. 18, showing a state of an apparatus body and process unit both of a current model.
Figure 19C:
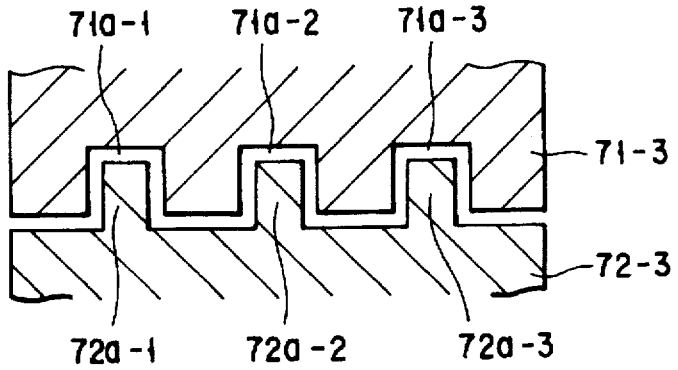
FIG. 19C is a view, taken along line XIX—XIX in FIG. 18, showing a state of an apparatus body and process unit both of a new model.

The recess 71*a* and projection 72*a* differ in numbers among the models. Suppose that there exist an old model, current model and new model in the same line of products. For the old model, a recess 71*a*-1 and projection 72*a*-1 are provided at a recess forming section 71-1 and projection forming section 72-1 as shown in FIG. 19A; for the current model, a recess 71*a*-2 and projection 72*a*-2 in addition to a recess 71*a*-1 and projection 72*a*-1 are also provided, respectively, at a recess forming section 71-2 and projection forming section 72-2 as shown in FIG. 19B; and for the new model, a recess 71*a*-3 and projection 72*a*-3 in addition to recesses 71*a*-1 and 71*a*-2 and projections 72*a*-1 and 72*a*-2 are also provided at a recess forming section 71-3 and projection forming section 72-3, respectively, as shown in FIG. 19C. FIG. 19A is a view, taken along line XIX—XIX in FIG. 18, showing the case where the process unit 101 of the old model is incorporated into the apparatus body of the old model. FIG. 19B is a view, taken along line XIX—XIX in FIG. 18, showing the case where the process unit 101 of the current model is incorporated into the apparatus of the current model. FIG. 19C is a view, taken along line XIX—XIX in FIG. 18, showing the case where the process unit 101 of the new model is incorporated into the apparatus of the new model.

As evident from such an arrangement, when the process unit 101 of the old model compatible in performance with the apparatus body of the old model is incorporated into that apparatus body, the recess 71*a*-1 of the recess forming section 71-1 is loosely fitted over the projection 72*a*-1 of the projection forming section 72-1 as shown in FIG. 19A. The depth of the recess 71 is so set that the projection 72 does not abut thereagainst when the process unit 101 is received in a normal state. As a result, the process unit 101 of the old model is received in the normal state in the unit receiving section of the apparatus body. Therefore, a unit detection switch 62 has its contact pressed by the bottom of the process unit 101 and is placed in a closed state, so that the unit detection switch 62 delivers a unit detection signal.

In the case where the process unit 101 of the current model compatible in performance with the apparatus body of the current model, the recess 71*a*-1 of the recess forming section 71-1 is loosely fitted over the projection 72*a*-1 of the projection forming section 72-1 and the recess 71*a*-2 of the recess forming section 71-1 over the projection 72*a*-2 of the projection forming section 72-1 as shown in FIG. 19B. As a result, the recess unit 101 of the current model is received in the normal state in the unit receiving section of the apparatus body. For this reason, the unit detection switch 62 has its contact pressed by the bottom of the process unit 101 and is closed, so that the unit detection switch 62 delivers a unit detection signal.

In the case where the process unit 101 of the new model compatible in performance with the apparatus body is incorporated into that apparatus body, the recess 71*a*-1 of the recess forming section 71-1 is loosely fitted over the projection 72*a*-1 of the projection forming section 72-1, the recess 71*a*-2 of the recess forming section 17-1 over the projection 72*a*-2 of the projection forming section 72-1 and the recess 71*a*-3 of the recess forming section 17-1 over the projection 72*a*-3 of the projection forming section 72-1 as shown in FIG. 19C. As a result, the process unit 101 of the new model is received in the normal state in the unit receiving section of the apparatus body. Therefore, a unit detection switch 62 has its contact pressed by the bottom of the process unit 101 and is placed in a closed state, so that the unit detection switch 62 delivers a unit detection signal.

In the case where the process unit 101 of a new model is incorporated into the apparatus body of an older type than the apparatus body compatible in performance with that process unit 101, there exist less projections than the recesses 71*a* and there certainly exist the recesses corresponding to the projections 72*a*. Therefore, the recesses 71*a* of the recess forming section 71 are loosely fitted over the corresponding projections of the projection forming section 72. Stated in more detail, for example, when the process unit 101 of the current model is incorporated into the apparatus body of the old model, the recess forming section 71-2 and projection forming section 72-1 are placed in an opposed relation to each other. One projection 72*a*-1 is provided on the projection forming section 72-1 and the recess 71*a*-1 is provided in the recess forming section 71-2 in a manner to correspond to the projection 72, so that the projection 72*a*-1 is loosely fitted in the recess 71*a*-1. As a result, the process unit 101 is received in a normal state in the unit receiving section of the apparatus body. For this reason, the unit detection switch 62 has its contact pressed by the bottom of the process unit 101 and is placed in the closed state, so that the unit detection switch delivers a unit detection signal.

Figure 19D:
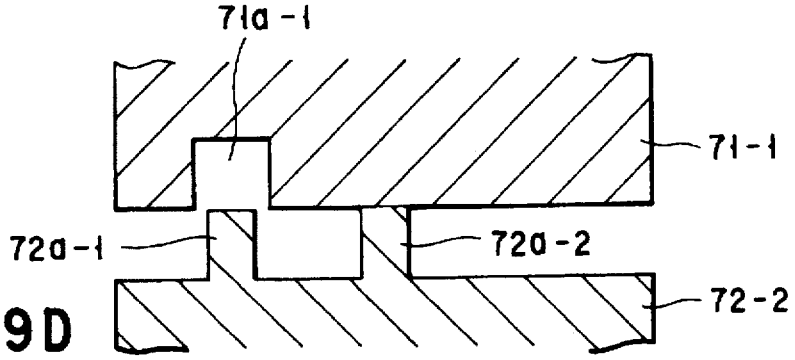
FIG. 19D is a view showing a state when a process unit of an old model is mounted in an apparatus body of a current model.

In the case where the process unit 101 of the old type is incorporated into the apparatus body of the newer type than the apparatus body compatible in performance with the process unit 101, there exist more projections 72*a* than the recesses 71*a* and there exists some projection 72*a* not corresponding to the recess 71. Such a projection 72*a* is not fitted into the recess 71*a* and abuts against the undersurface of the recess forming section 71. Stated in more detail, if the process unit 101 of the older model is incorporated into the apparatus body of the current model for instance, the recess forming section 71-1 and projection forming section 72-2 are set in an opposed relation to each other. In this case, two projections 72*a*-1 and 72*a*-2 are provided on the projection forming section 72-2 and only one recess 71*a*-1 is formed in the recess forming section 71-1 in a way to correspond to the projection 72*a*-1, so that the projection 72*a*-2 abuts against the undersurface of the recess forming section 71-1 as shown in FIG. 19D. As a result, the process unit 101' of the old model is floated at one side in the unit receiving section of the apparatus body of the current model and is not received in the normal state. Therefore, the unit detection switch 62 has its contact not contacted with the bottom of the process unit 101 and is placed in an open state, so that the unit detection switch 62 delivers a unit non-detection signal.

Even the present embodiment can achieve the same advantage as in the first embodiment by monitoring the output signal of the unit detection switch 62, by the same electric circuit as shown in the first embodiment, in the same process steps as shown in the first embodiment.

According to the present invention, the number of the recesses 71*a* and projections 72*a* can be properly varied and, for the case of four or more types of models, preparation can be made against this situation. In this case, the more the new models, the more recesses 71*a* and projections 72*a* have to be provided.

(Fourth Embodiment)

Figure 20:
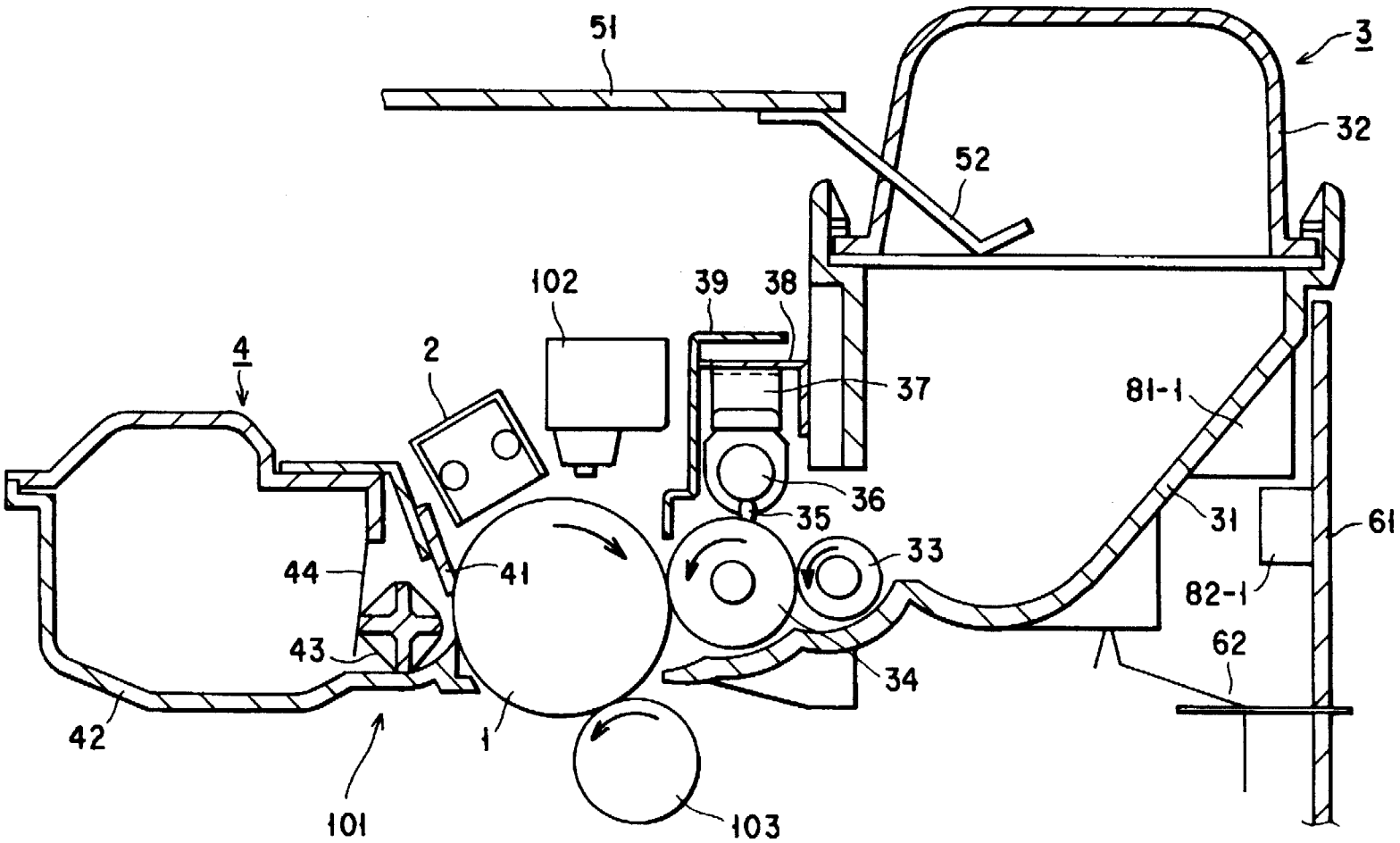
FIG. 20 is a view, partly taken away, showing a practical arrangement showing a process unit in a facsimile apparatus (old model) incorporating therein an electrophotographic apparatus according to a fourth embodiment of the present invention and its peripheral area.
Figure 21:
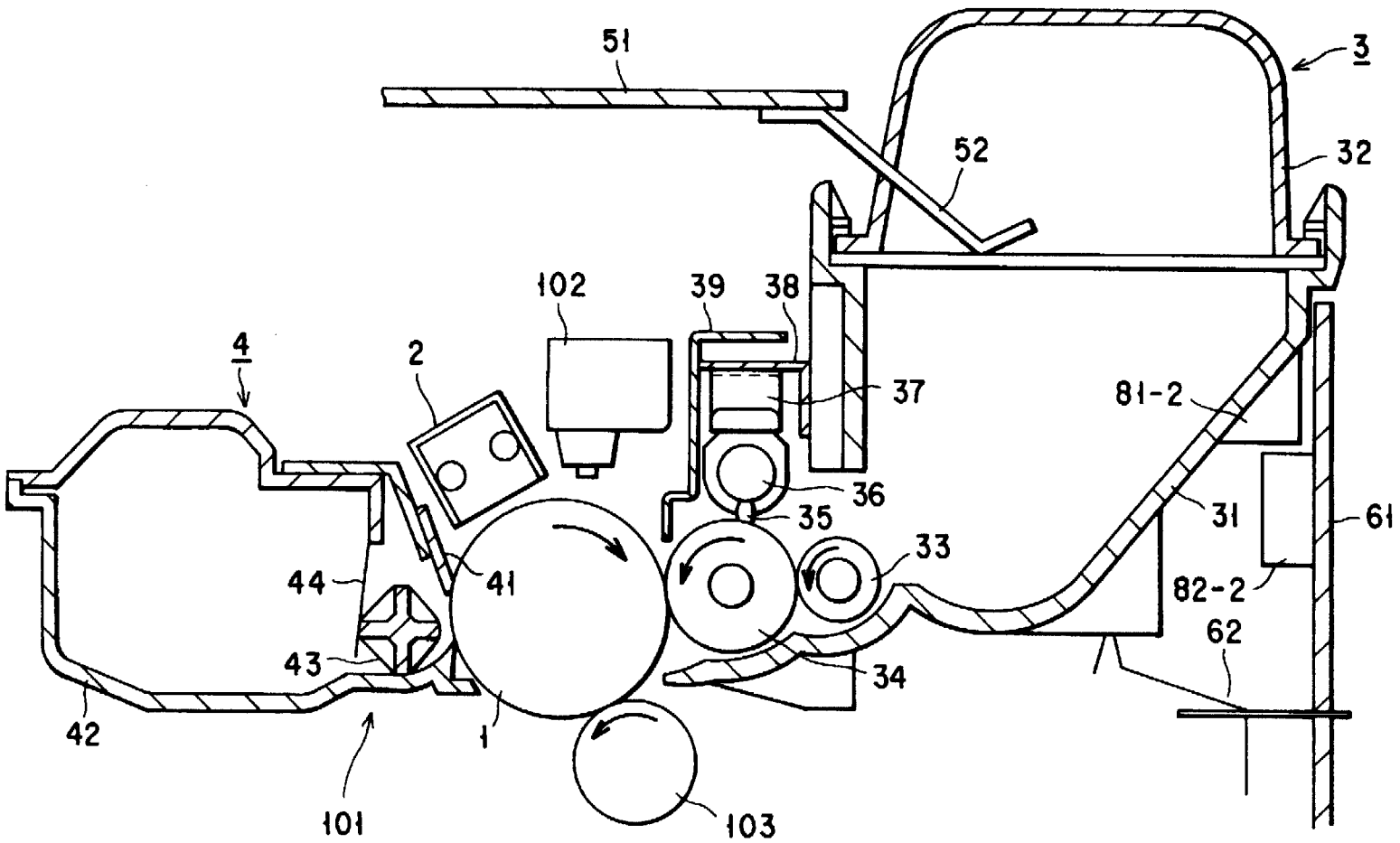
FIG. 21 is a view, partly taken away, showing a practical arrangement of a facsimile apparatus (current model) incorporating therein the electrophotographic apparatus according to the fourth embodiment of the present invention and its peripheral area.
Figure 22:
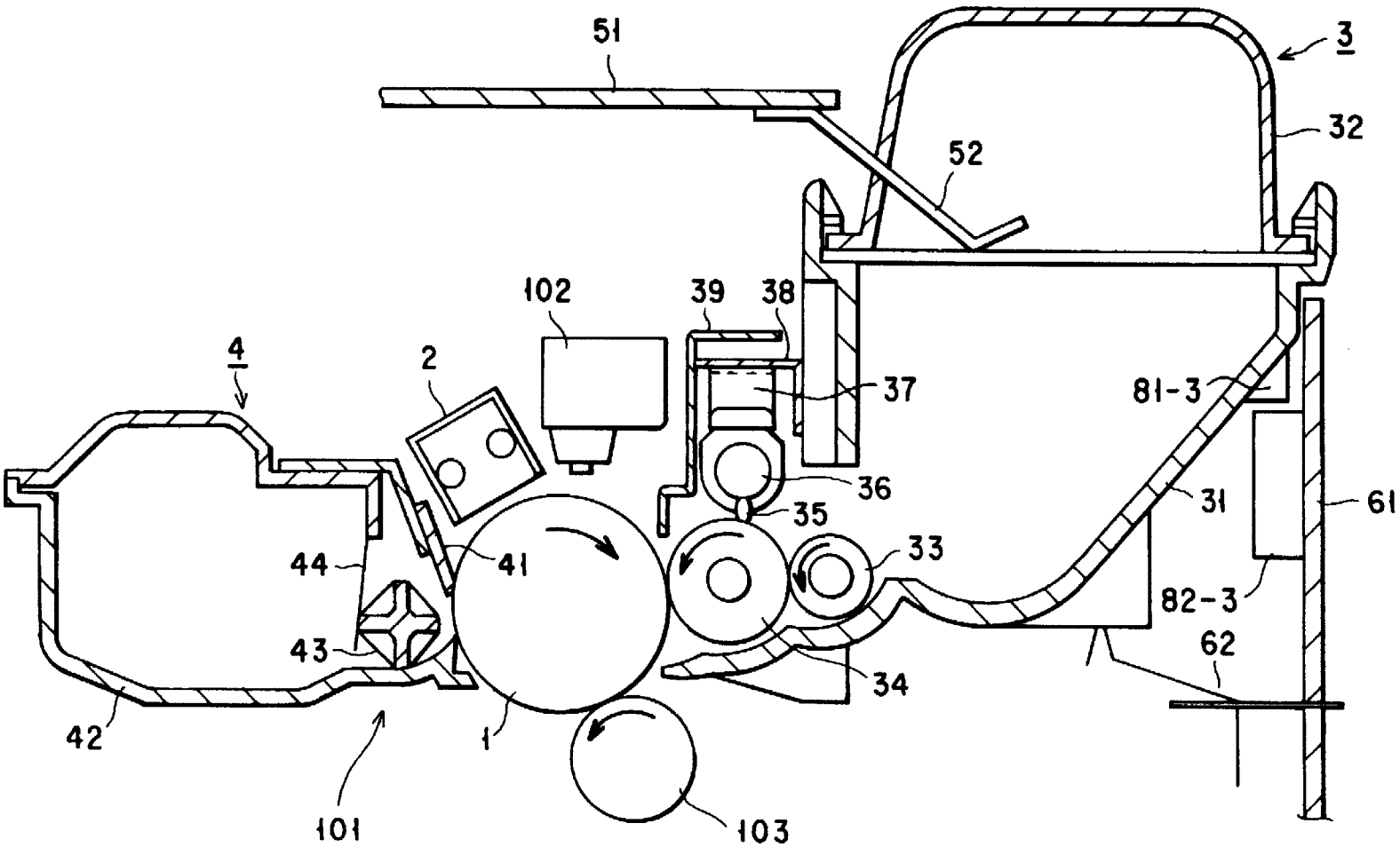
FIG. 22 is a view, partly taken away, showing a practical arrangement of a process unit of a facsimile apparatus (new model) incorporating therein the electrophotographic apparatus according to the fourth embodiment of the present invention and its peripheral area.

FIGS. 20 to 22 are views, partly taken away, showing a practical arrangement of a process unit in a facsimile apparatus therein incorporating an electronic photographic apparatus according to a fourth embodiment of the present invention and its surrounding area, FIG. 20 showing an old model, FIG. 21 a current model and FIG. 22 a new model. A whole arrangement of the facsimile apparatus and its associated electric circuit is in the same as in the first embodiment and, here, its illustration and detailed explanation are omitted for brevity.

In the old model as shown in FIG. 20, a projection 81-1 is integrally provided on a process unit of the same arrangement as the facsimile apparatus of the new model in the present invention and a projection 82-1 is integrally provided on the second wall of a chassis 61 of the apparatus body 61. These projections 81-1 and 82-1 are arranged in such an opposed relation that, when the process unit 101 is placed in a normal state, the lower face of the projection 81-1 does not abuts against the upper face of the projection 82-1.

In the current model as shown in FIG. 21, a projection 81-2 is integrally provided on a process unit 101 of the same arrangement as the facsimile apparatus of a new model and a projection 82-2 is integrally provided on the side wall of a chassis 61 of an apparatus body. These projections 81-2 and 82-2 are arranged in such an opposed relation that, when the process unit 101 is placed in the normal state in the apparatus body, the lower face of the projection 81-2 does not abut against the upper face of the projection 81-2. In this connection it is to be noted that the lower face of the projection 82-2 and upper face of the projection 82-2 are so set as to located in a position higher than the lower face of the projection 81-1 in the old model.

In the new model as shown in FIG. 22, a projection 81-3 is integrally provided on a process unit 101 of the same arrangement as the facsimile apparatus of the new model in the first embodiment and a projection 82-3 is integrally provided on the side wall of a chassis 61 of the apparatus body. These projections 81-3 and 82-3 are arranged in an opposed relation such that, when the process unit 101 is received in a normal state in the apparatus body, the lower face of the projection 81-3 does not abut against the upper face of the projection 82-3. The lower face of the projection 81-3 and upper face of the projection 82-3 are located in a position higher than the lower face of the projection 81-2 in the current model.

As evident from such arrangement, if the process unit 101 compatible in performance with the apparatus body is incorporated in that apparatus, these old, current and new models are so arranged as to take on a state, as shown in FIG. 20, for the old model, a state, as shown in FIG. 21, for the current model and a state, as shown in FIG. 22, for the new model, so that the projection 81 (81-1, 81-2, 81-3) does not abut against the projection 82 (82-1, 82-2 and 82-3). As a result, the process unit 101 is received in the normal state in the unit receiving section of the apparatus body. Therefore, the unit detection switch 62 has its contact pressed by the bottom of the process unit 101 and is placed in a closed state, so that the unit detection switch 62 delivers a unit detection signal.

In the case where a new type of a process unit 101 is incorporated into an apparatus body older in type than the apparatus body compatible in performance with that process unit 101, since the upper face of the projection 82 is set to be higher the newer the model, the lower face of the projection 81 is situated at a higher position than the upper face of the projection 82. As a result, the process unit 101 is placed in a normal position in the unit receiving section of the apparatus body. Therefore, the unit detection switch 62 has its contact pressed by the bottom of the process unit 101 and is placed in a closed state, so that a unit detection signal emerges from the unit detection switch 62.

Figure 23:
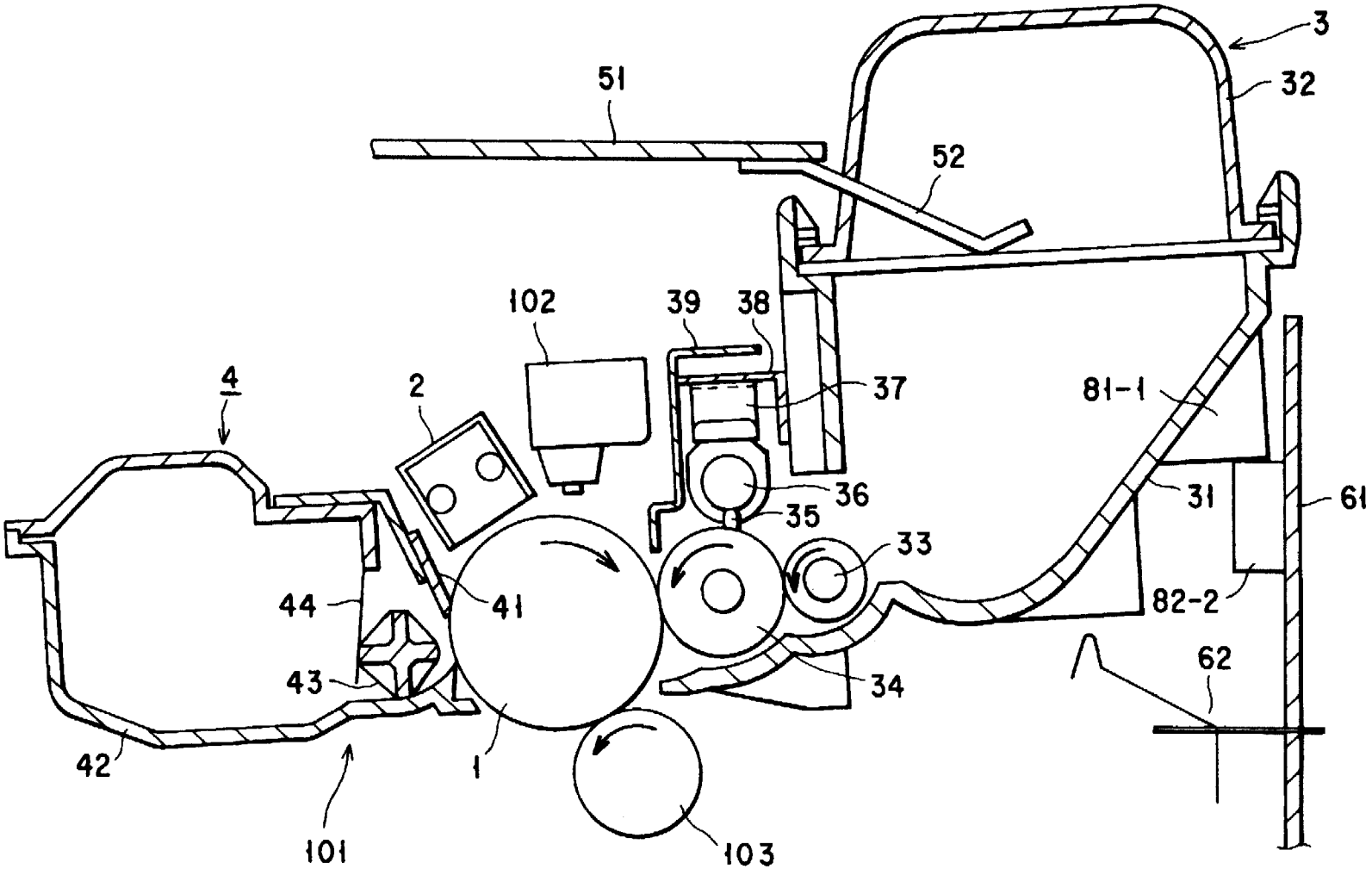
FIG. 23 is a view, partly taken away, showing a process unit of the facsimile apparatus incorporating therein the electrophotographic apparatus according to the fourth embodiment of the present invention and its peripheral area, a view showing a state when a process unit of an old model is mounted in the apparatus body of a current model.

In the case where an old type of a process unit 101 is incorporated into the apparatus body newer in type than the apparatus body compatible in performance than that process unit 101, the lower face of the projection 81 when the process unit 101 is received in the normal position is located in a position lower than the upper face of the projection 82 so that the lower face of the projection 81 abuts against the upper face of the projection 82. Stated in more detail, when a process unit 101 of an old model is incorporated into an apparatus body of a current model for example, the lower face of a projection 81-1 abuts against the upper face of a projection 82-2 as shown in FIG. 23. As a result, the process unit 101 is floated on one side in the unit receiving section of the apparatus body and not received in the normal state. Therefore, the unit detection switch 62 has its contact not contacted with the bottom of the process unit 101 and is placed in an open state, so that a unit non-detection signal emerges from a unit detection switch 62.

Thus even this invention can achieve the same advantage as in the first embodiment by monitoring the output signal of the unit detection switch 62 by the same electric circuit as in the first embodiment in the same procedure as in the first embodiment.

According to the present embodiment, even if there are more than three kinds of models present, preparation can be made for this situation by properly varying the lower face of the projection 81 and upper face of the projection 82 in different positions. In this connection it is to be noted that the lower face of the projection 81 when the process unit 101 is received in the normal state needs to be set lower in position then the upper face of the projection 82 on the older model.

The present invention is not restricted to the above-mentioned embodiments. Although, in the respective embodiments for example, the present invention has been explained as being applied to the electrophotographic apparatus in the facsimile apparatus, it may be applied to a printer apparatus for printing out data items delivered from word processor, personal computers, etc., and to an electrophotographic apparatus for use in a so-called copying apparatus.

Although, in the first embodiment, the projection 30 and cutout 61*a* are provided at the process unit 101' and chassis 61' of the apparatus body, respectively, it may be possible to provide the projection on the chassis 61' of the apparatus body and the cutout 61*a* in the process unit 101'.

Although, in the second embodiment, the projection and cutout are provided at the process unit and chassis of the apparatus body, respectively, it may be possible to provide the projection on the chassis of the apparatus body and the cutout in the process unit. In this case, the width of the projection is set to be smaller than that of the cutout of the newer model.

Although, in the third embodiment, the recess and projection are provided at the process unit and chassis of the apparatus body, respectively, it may be possible to provide the recess in the cassis of the apparatus body and the projection on the process unit. In this case, the more recesses and projections may be provided the older the models.

The arrangement of the fitting/engaging structure, arrangements of the receiving state determining means and operation state setting means, arrangement of the process unit and apparatus body, and so on can be variously changed or modified without departing from the spirit and scope of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrophotographic device for enabling an electrophotographic process unit to be detachably received in an inner receiving section of an electrophotographic apparatus body, the electrophotographic apparatus body being selected from a plurality of kinds of apparatus bodies differing in their performances including an older type apparatus body and a new type apparatus body, and the electrophotographic process unit being selected from a plurality of kinds of process units including an older type process unit corresponding to the older type apparatus body and a newer type process unit corresponding to the newer type apparatus body, said electrophotographic device comprising:

a fitting structure integrally provided on at least one of the electrophotographic apparatus body and the electrophotographic process unit, wherein said fitting structure enables the electrophotographic process unit to be received in the inner receiving section of the electrophotographic apparatus body in a predetermined state when the electrophotographic apparatus body is the older type apparatus body and the electrophotographic process unit is one of the older type process unit and the newer type process unit, wherein said fitting structure enables the electrophotographic process unit to be received in the inner receiving section of the electrophotographic apparatus body in the predetermined state when the electrophotographic apparatus body is the newer type apparatus body and the electrophotographic process unit is the newer type process unit, and wherein said fitting structure prevents the electrophotographic process unit from being received in the inner receiving section of the electrophotographic apparatus body in the predetermined state when the electrophotographic apparatus body is the newer type apparatus body and the electrophotographic process unit is the older type process unit.

2. The electrophotographic device according to claim 1, wherein said fitting structure comprises:

a projection provided on a selected one of the older type process unit and the newer type apparatus body, said projection abutting against the other one of the older type process unit and the newer type apparatus body when the older type process unit is mounted in the newer type apparatus body; and a cutout provided in the other one of the older type apparatus body and the newer type process unit, said cutout receiving the projection except when the older type process unit is mounted in the newer type apparatus body.

3. The electrophotographic device according to claim 2, wherein the projection is provided on the older type process unit and the cutout is provided in a chassis of the older type apparatus body.

4. The electrophotographic device according to claim 1, wherein said fitting structure comprises:

a projection provided on the electrophotographic process unit and a cutout provided in the electrophotographic apparatus body, and wherein the projection and the cutout are mutually associated such that: (i) the cutout in the older type apparatus body is greater in width than the projection on the older type process unit, (ii) the cutout in the newer type apparatus body is greater in width than the projection on the newer type process unit, (iii) the projection on the newer type process unit is smaller in width than the cutout in the older type apparatus body, and (iv) the projection on the older type process unit is greater in width than the cutout in the newer type apparatus body, so that the cutout in the electrophotographic apparatus body receives the projection in the electrophotographic process unit except when the older type process unit is mounted in the newer type apparatus body.

5. The electrophotographic device according to claim 1, wherein the fitting structure comprises:

at least one recess provided in the electrophotographic process unit and at least one projection provided on the electrophotographic apparatus body, and wherein the at least one recess and the at least one projection are mutually associated such that: (i) the older type process unit and the older type apparatus body have an equal number of recesses and projections located in corresponding positions, (ii) the newer type process unit and the newer type apparatus body have an equal number of recesses and projections located in corresponding positions, (iii) the number of recesses on the newer type process unit is greater than the number projections on the older type apparatus body, and (iv) the newer type process unit includes recesses corresponding to each of the recesses provided in the older type process unit, so that the at least one recess on the electrophotographic process unit receives the at least one projection on the electrophotographic apparatus body except when the older type process unit is mounted in the newer type apparatus body.

6. The electrophotographic device according to claim 1, wherein the fitting structure comprises:

an engaging device which comprises a projection on the electrophotographic apparatus body and a projection on the electrophotographic process unit, and wherein said projections are mutually associated so as to be non-abuttingly opposed to each other when the electrophotographic process unit to be received in the inner receiving section of the electrophotographic apparatus body is the newer type process unit and the electrophotographic apparatus body is one of the older type apparatus body and the newer type apparatus body, wherein said projections are mutually associated so as to be non-abuttingly opposed to each other when the electrophotographic process unit to be received in the inner receiving section of the electrophotographic apparatus body is the older type process unit and the electrophotographic apparatus body is the older type apparatus body, and wherein said projections are mutually associated so as to be abuttingly opposed to each other when the electrophotographic process unit to be received in the inner receiving section of the electrophotographic apparatus body is the older type process unit and the electrophotographic apparatus body is the newer type apparatus body.

7. The electrophotographic device according to claim 1, further comprising:

a deciding device for deciding whether or not the electrophotographic process unit is received in the predetermined state in the inner receiving section of the electrophotographic apparatus body; and a setting device for setting at least said electrophotographic process unit in an inoperative state when the deciding device decides that the electrophotographic process unit is not received in the predetermined state in the inner receiving section of the electrophotographic apparatus body.

8. The electrophotographic device according to claim 7, wherein said deciding device comprises a sensor for detecting a presence and absence of the electrophotographic process unit so as to decide, based on an output of the sensor, whether or not the electrophotographic process unit is received in the predetermined state.

9. The electrophotographic device according to claim 7, further comprising an informing device for informing a user of the electrophotographic apparatus that the electrophotographic process unit has been incorrectly received when said deciding device decides that the electrophotographic process unit is not received in the predetermined state.

10. The electrophotographic device according to claim 9, wherein said informing device comprises a display for displaying at least one of a predetermined message and predetermined mark when said deciding device decides that the electrophotographic process unit is not received in the predetermined state.

* * * * *